US007823636B2

(12) United States Patent
Lucas

(10) Patent No.: US 7,823,636 B2
(45) Date of Patent: Nov. 2, 2010

(54) PACKER

(75) Inventor: Chad M. Lucas, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 536 days.

(21) Appl. No.: 11/852,648

(22) Filed: Sep. 10, 2007

(65) Prior Publication Data

US 2009/0065192 A1 Mar. 12, 2009

(51) Int. Cl.
*E21B 33/12* (2006.01)

(52) U.S. Cl. ..... 166/119; 166/387

(58) Field of Classification Search ..... 166/119, 166/386, 387

See application file for complete search history.

(56) References Cited

U.S. PATENT DOCUMENTS 5,595,246 A 1/1997 Voll
5,746,274 A 5/1998 Voll
6,202,742 B1 * 3/2001 Echols ..... 166/51
6,513,599 B1 * 2/2003 Bixenman et al. ..... 166/378
6,659,177 B2 12/2003 Bolze
6,666,276 B1 12/2003 Yokley
6,782,954 B2 * 8/2004 Serafin et al. ..... 166/387
6,892,820 B2 5/2005 Divis
7,017,670 B2 3/2006 Hazel
7,220,067 B2 5/2007 Rubinstein
7,231,971 B2 6/2007 McCalvin
7,510,016 B2 * 3/2009 Telfer ..... 166/387
2002/0062962 A1 * 5/2002 Gary et al. ..... 166/305.1
2009/0283280 A1 * 11/2009 Themig ..... 166/387

* cited by examiner

*Primary Examiner*—Daniel P Stephenson
(74) *Attorney, Agent, or Firm*—Rodney Warfford

(57) ABSTRACT

A packer includes first and second external seal elements. The first external seal element is adapted to form an annular seal in the well. The second external seal element is adapted to be moved in response to fluid in the well to produce a force to at least partially assist an operation of the packer.

23 Claims, 5 Drawing Sheets

PACKER

BACKGROUND

The invention generally relates to a packer.

A packer is a device that is used in a well to form an annular seal between an inner tubular member and a surrounding outer tubular member (a casing string or a liner, as just a few examples) or borehole wall. As examples, the inner tubular member may be a tubular string (a test string, production string, work string, etc.) or may be part of a downhole tool (a formation isolation valve, bridge plug, etc.).

One type of conventional packer has a seal element that is formed from a set of elastomer seal rings. The rings are sized to pass through the well when the packer is being run downhole into position. When the packer is in the appropriate downhole position and is to be set, gages of the packer compress the rings to cause the rings to radially expand to form the annular seal.

A weight-set packer uses the weight of the string and possibly the weight of additional collars to compress the packer's seal rings. In this regard, when the packer is to be set, the string may be mechanically manipulated from the surface of the well to initiate the release of the weight on the rings.

A hydraulically-set packer uses fluid pressure to compress the seal rings. The fluid pressure may be pressure that is communicated downhole through a tubing string; annulus pressure; pressure that is communicated downhole through a control line; etc.

Other types of packers may include seal elements that are set without using compression. For example, a packer may have an inflatable bladder that is radially expanded to form an annular seal using fluid that is communicated into the interior space of the bladder through a control line. As another example, a packer may have a swellable material that swells in the presence of a well fluid or other triggering agent to form an annular seal.

SUMMARY

In an embodiment of the invention, a packer includes first and second external seal elements. The first external seal element is adapted to form an annular seal in a well. The second external seal element is adapted to be moved in response to fluid in the well to produce a force to at least partially assist an operation of the packer.

In another embodiment of the invention, a technique includes providing a first external seal element of a packer to form an annular seal in a well. The technique also includes moving a second external seal element of the packer in response to fluid in the well to produce a force to at least partially assist an operation of the packer.

In another embodiment of the invention, a system includes a slip, a piston, a first external seal element and a second external seal element. The first external seal element is adapted to be compressed by the piston to form an annular seal in a well. The second external seal element is adapted to be moved in response to fluid in the well to produce a force on the piston to at least partially assist the compression of the first external seal element by the piston.

In yet another embodiment of the invention, a packer includes first and second external seal elements. The first external seal element is adapted to form an annular seal in a well. The second external seal element is adapted to be moved in response to fluid in the well to produce a force to at least partially assist an operation of a downhole tool.

Advantages and other features of the invention will become apparent from the following drawing, description and claims.

DETAILED DESCRIPTION

Figure 1:
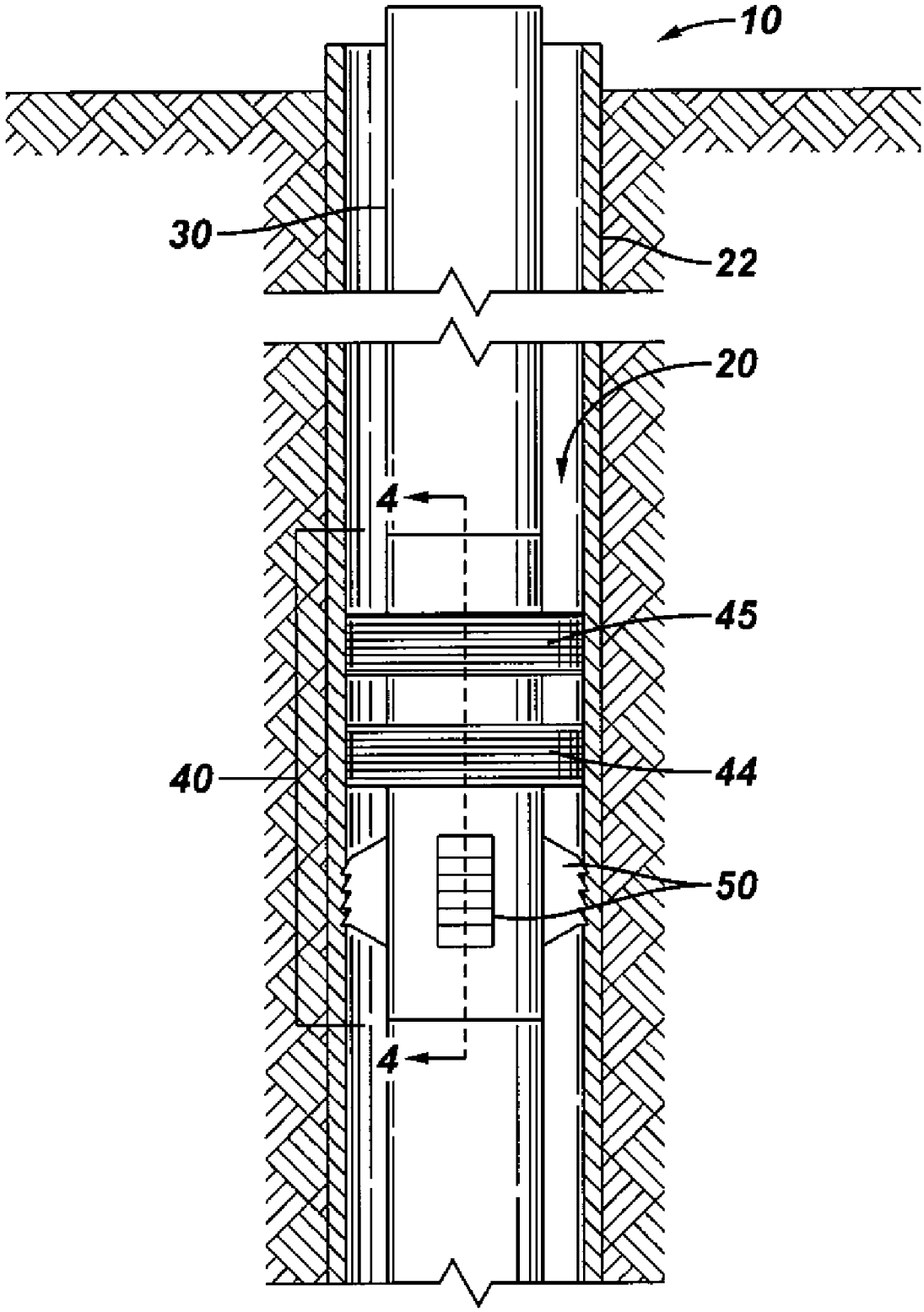
FIGS. 1 and 6 are schematic diagrams of wells according to embodiments of the invention.

Referring to FIG. 1, an embodiment 10 of a well (a subterranean or subsea well) in accordance with the invention includes a tubular string 30, which extends downhole into a wellbore 20. As depicted in FIG. 1, in accordance with some embodiments of the invention, the wellbore 20 may be lined with a casing string 22, although the wellbore 20 may be uncased in accordance with other embodiments of the invention. Additionally, although FIG. 1 depicts a vertical wellbore, the wellbore may alternatively be a lateral or a deviated wellbore.

The string 30 includes a packer 40 for purposes of forming an annular seal in the well 10. In this regard, the packer 40 may be mm downhole in an unexpanded state, a state in which a resilient primary annular seal element 44 (herein called the "primary seal element 44") of the packer 40 is in a retracted, or unexpanded, state. When the packer 40 is in the appropriate downhole position, measures may then be undertaken (as described herein) to set the packer 40. In general, the setting of the packer 40 causes the packer 40 to compress the primary seal element 44 to radially expand the element 44 to form the annular seal. Also, when the packer 40 is set, dogs, or slips 50, of the packer 40 radially expand and engage the wall of the casing string 22 to anchor the packer 40 to the string 22. In accordance with other embodiments of the invention, the packer 40 may alternatively be used to seal against surfaces other than the interior surface of a casing string 22, such as the interior surface of a liner or the surface defined by a wellbore wall, as just a few examples.

It is noted that the string 30 is merely an example of one out of many possible conveyance devices that may be used to run the packer 40 downhole. Thus, depending on the particular embodiment of the invention, another conveyance device, such as a wireline, slickline, etc. may be used to run the packer 40 downhole. The conveyance device may or may not (as depicted in FIG. 1) contain a packer setting tool depending on the particular embodiment of the invention. For embodiments of the invention in which the string 30 is used as the conveyance device, the string 30 may be, as examples, a coiled tubing string or formed from jointed tubing sections.

As described herein, the packer 40 includes an additional external seal element, a secondary resilient external seal element 45 (herein called the "secondary seal element 45"), to at least partially assist an operation of the packer 40, such as an operation that is involved with setting the packer 40 (i.e., an operation that involves the radial expansion of the primary seal element 44 and/or the radial expansion of the slips 50). In particular, as described herein, the secondary seal element 45 responds to differential pressure of well fluid to produce a force that at least partially assists the packer operation. As described further below, in accordance with some embodiments of the invention, the force that is produced by the seal element 45 may be used to at least partially assist the operation of a downhole tool that may or may not be part of the packer 40.

Depending on the particular embodiment of the invention, the force that is generated by the action of the secondary seal element 45 may be the primary force that drives the assisted operation or may, alternatively, be a secondary force to supplement a primary force that is generated using an actuator of the packer 40 (an actuator that is actuated using conventional hydraulic, weight-set or electrical actuation techniques, as examples). The actuator may alternatively be part of a packer setting tool that is part of the string 30 (for example).

The primary 44 and secondary 45 seal elements form a staged sealing system that establish a staged reduction in the differential pressure holding capacity of each seal element 44, 45. Thus, the overall seal array system formed from the primary 44 and secondary 44 seal elements holds a greater differential pressure than individually exists across each seal element 44, 45.

Figure 2:
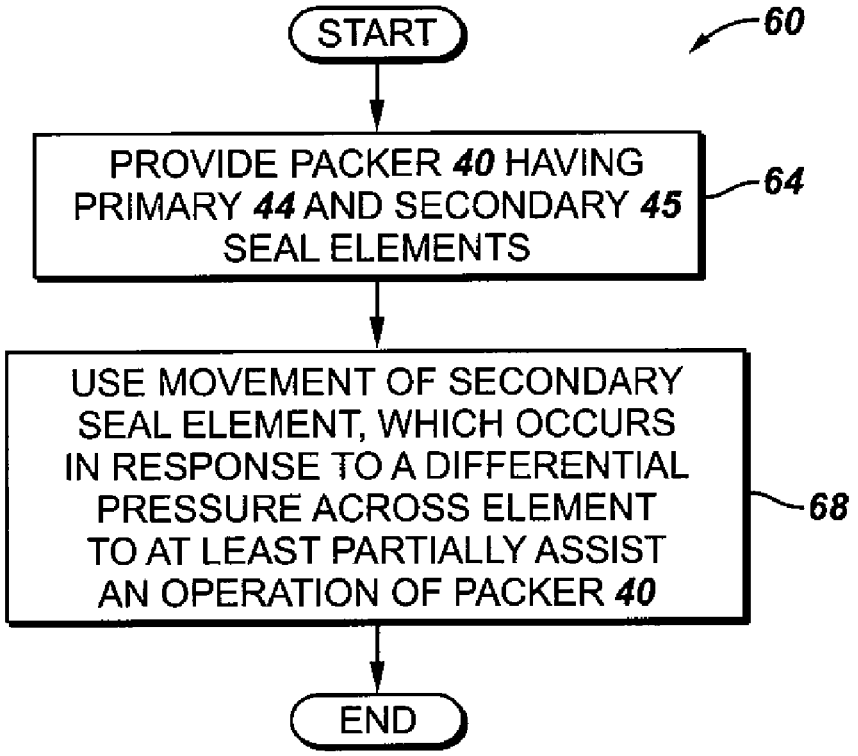
FIGS. 2, 3 and 7 are flow diagrams depicting techniques that use a secondary external seal element of a packer to at least partially assist a downhole operation according to embodiments of the invention.

Referring to FIG. 2 in conjunction with FIG. 1, to summarize, a technique 60 that is usable with a well includes providing (block 64) a packer 40 that has primary 44 and secondary 45 seal elements. Movement of the secondary element 45, which occurs in response to a differential pressure across the element 45 is used (block 68) to at least partially assist an operation of the packer 40.

Referring back to FIG. 1 as a more specific example, in accordance with some embodiments of the invention, the primary 44 and secondary 45 seal elements are both initially set (i.e., the seal elements 44 and 45 are compressed), as depicted in FIG. 1, to form corresponding annular seals in the well 10. Thus, each seal 44, 45 expands to form an annular barrier between the outer surface of the tubular string 30 and the inner surface of the casing string 22. For the first example of a packer described herein, the primary seal element 44, secondary seal element 45 and slips 50 are set according to the following staged sequence: first, the slips 50 are deployed; then the primary seal element 44 and is deployed; and lastly, the secondary seal element 45 is deployed. It is noted, however, that in other embodiments of the invention, the components of the packer may be deployed in a different sequence. In some embodiments of the invention, the staged sealing system may be arranged on the packer 49 to aid in a directional sealing scenario, where the importance is to hold differential pressures from one target direction.

The setting of the secondary seal element 45 creates a differential pressure across the element 45, which is used, in accordance with some embodiments of the invention, to impart an additional loading force on the primary seal element 44. In this regard, the differential pressure moves the secondary seal element 45 to further compress the primary seal element 44 beyond the compression achieved with the initial setting force. The differential pressure may be created by, as a few examples, naturally occurring wellbore pressure, hydrostatic pressure, pressure applied from the surface of the well 10, or a combination of one or more of these.

Figure 3:
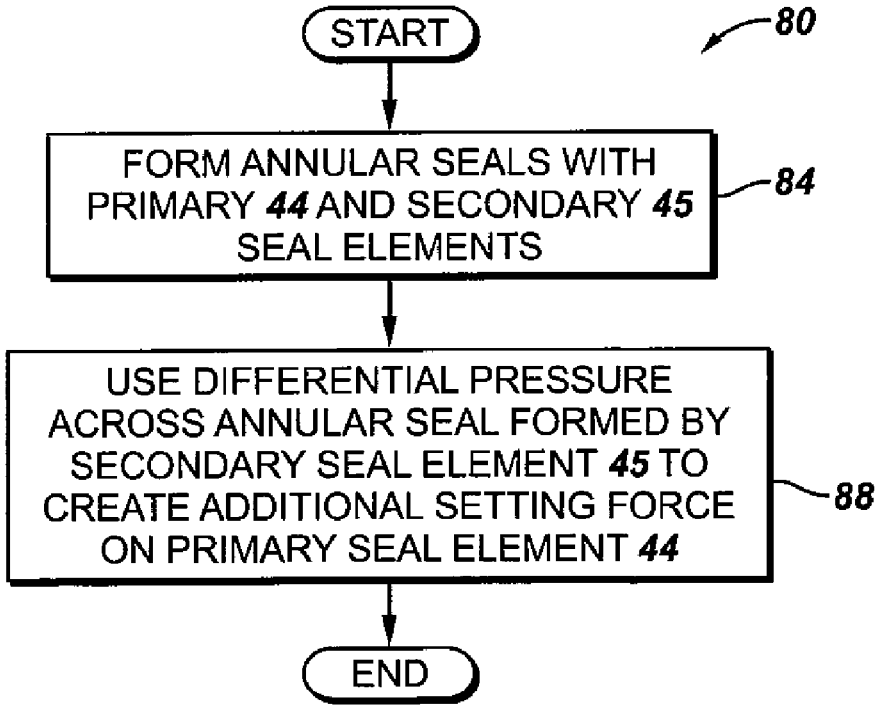

Referring to FIG. 3, to summarize, a technique 80 may be used in accordance with some embodiments of the invention to assist a packer operation. Pursuant to the technique 80, annular seals are formed using the primary 44 and secondary 45 seal elements, pursuant to block 84. The differential pressure that is created across the annular seal that is formed by the secondary seal element 45 is used (block 88) to create an additional setting force on the primary seal element 44.

Figure 4:
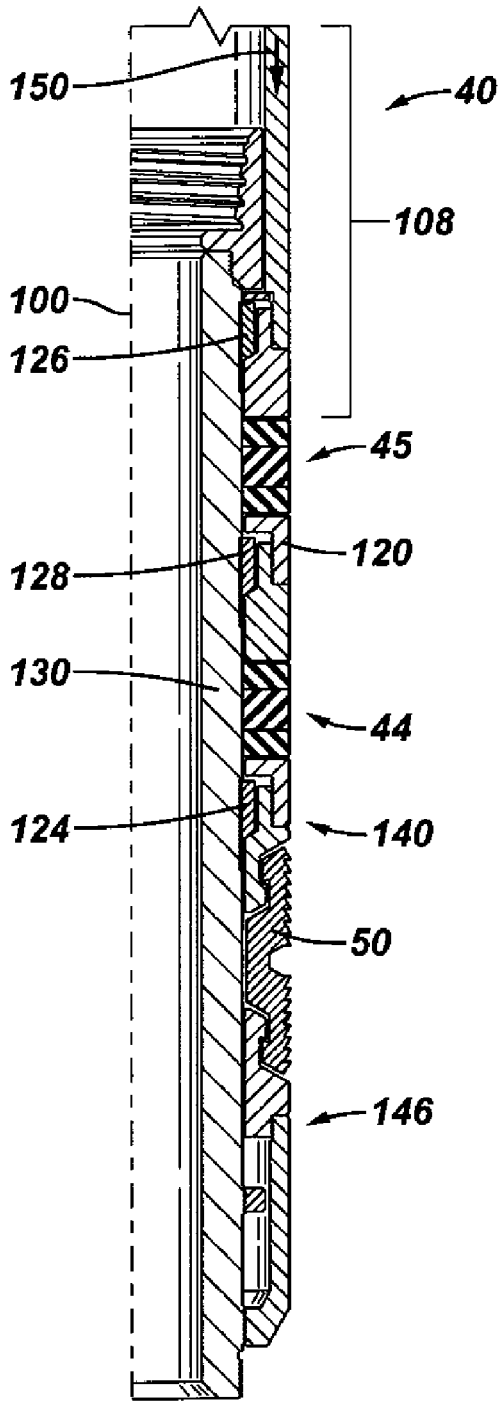
FIG. 4 is a partial cross-sectional view of the packer taken along line 4-4 of FIG. 1 according to an embodiment of the invention.

As a more specific example, FIG. 4 depicts a partial cross-sectional view of the packer 40 in accordance with some embodiments of the invention. In particular, FIG. 4 depicts a right-hand cross-sectional view of the packer 40 about a longitudinal axis 100 of the packer 40 and is taken along line 4-4 of FIG. 1. The longitudinal axis 100 is coaxial with the string 30 (see FIG. 1) near the packer 40. As can be appreciated by one of skill in the art, the true cross-section of the packer 40 along line 4-4 of FIG. 1 also includes a mirroring left-hand cross section on the left-hand side of the longitudinal axis 100, as the packer 40 is generally symmetrical about the longitudinal axis 100.

As depicted in FIG. 4, the primary seal element 44 may be formed from multiple sealing rings. The number of sealing rings, whether more or less than the three sealing rings that are depicted in FIG. 4, may be selected based on the expected environment of the packer 40 and the overall application for which the packer 40 is to be used. It is noted that the seal rings may be an elastomer, or may be formed from other materials. For example, in accordance with other embodiments of the invention, all or part of the seal rings may be formed from a swellable material, plastic, composite, or a combination of materials. Thus, many variations are contemplated and are within the scope of the appended claims. The secondary seal element 45 may be formed in a similar manner to the primary seal element 44 from one or more sealing rings, depending on the particular embodiment of the invention.

In general, the primary 44 and secondary 45 seal elements are radially expanded due to their compression by the axial translation of a piston 108. In this regard, in accordance with some embodiments of the invention, the piston 108 moves in a downwardly direction (for the embodiment depicted in FIG. 4) due to a force 150 that may be generated by a conventional mechanical or hydraulically-based actuator, as just a few examples. More specifically, as examples, the force 150 may be generated by the transfer of a true mechanical load; by a mechanical load delivered by a secondary setting tool; by a hydraulic setting system built into the packer body; or by a combination of these setting variations.

As depicted in FIG. 4, the piston 108 may be located above the secondary seal element 45 and abut the element 45. A slidable collar 120 is located between the upper secondary seal element 45 and the lower primary seal element 44. An upper cone assembly 140 is located below the primary seal element 44 and the slips, such as the exemplary slip 50 depicted in FIG. 4 is mounted and connected to the upper cone assembly 140. A lower cone assembly 146 is located below the slips 50, such as the exemplary slip 50 that is depicted in FIG. 4.

The above-described components of the packer, such as the primary and second seal elements, piston 108, collar 128, cone assemblies 140 and 146 and slips 50 are concentric with and are mounted on an inner carrier mandrel 130. Some of these components may be fixed to the inner carrier mandrel 130 (via shear pins, for example) during the run-in-hole state of the packer 40, in accordance with some embodiments of the invention for purposes of preventing inadvertent setting of the packer 40. When the packer 40 is to be set, the force 150 is generated, which compresses the primary seal element 44 between the collar 120 and the upper cone assembly 140 and compress the secondary seal element 45 between the piston 108 and the collar 120. This compression, in turn, radially expands the primary 44 and secondary 45 seal elements to form corresponding annular seals in the well 10. Additionally, the above-described movement of the components of the packer 40 also radially expands the slips 50.

For purposes of maintaining the initial, radially-expanded positions of the primary 44 and the secondary 45 seal elements when first set due to the force 150, the packer 40 includes a locking device, such as a ratchet, which is formed from a ratchet ring 126 that is located inside the piston 108. The ratchet ring 126 has inner ratchet teeth that engage corresponding ratchet teeth that are formed on the outer surface of the inner carrier mandrel 130 for purposes of securing the forward progress of the piston 108 as the piston 108 moves in a downwardly direction to further compress the primary 44 and secondary 45 seal elements.

Thus, after the primary 44 and secondary 45 seal elements are initially set to form the corresponding annular seals, a differential pressure exists across the secondary seal element 45, and this differential pressure, in turn, may be used to apply an additional setting force to the primary seal element 44. More specifically, FIG. 5 depicts a more detailed cross-sectional view of the portion of the packer 40 in accordance with some embodiments of the invention.

Figure 5:
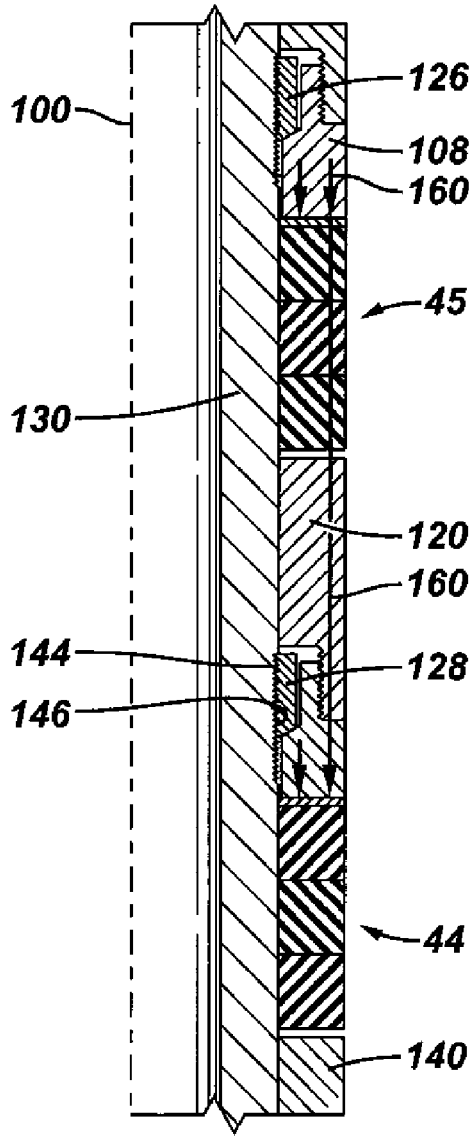
FIG. 5 is a more detailed partial cross-sectional view of the packer according to an embodiment of the invention.

Referring to FIG. 5 in conjunction with FIG. 4, in accordance with some embodiments of the invention, for purposes of allowing the pressure differential across the primary 44 and secondary 45 seal elements to introduce an additional compressive setting force (beyond the force 150 that achieves the initial seal) onto the seal elements 44 and 45, the packer 40 includes another locking device, such as a ratchet, which is located between the seal elements 44 and 45. The inclusion of the locking device permits the progressive buildup of setting force that translates into an increased differential pressure holding capacity for the packer 40. As a more specific example, in accordance with some embodiments of the invention, the locking device is a ratchet, which includes a ratchet ring 128 that resides inside the collar 120. The ratchet 128 generally circumscribes the outside of the inner carrier mandrel 130 and includes ratchet teeth 144 that mate with corresponding ratchet teeth 146 that are formed on the outer surface of the carrier mandrel 130. Thus, downward axial movement of the secondary seal element 45 causes corresponding downward movement of the collar 120 to further compress the primary seal element 44; and the forward progress of the collar's position is maintained by the ratchet. As depicted in FIG. 5, the differential pressure on the secondary seal element 45 produces a loading force 160 that is communicated from the seal element 45, through the collar 120 and to the primary seal element 44.

It is noted that the packer 40 that is depicted in FIGS. 1, 4 and 5 is merely an example in accordance with some embodiments of the invention. However, other embodiments are contemplated and are within the scope of the appended claims. For example, in accordance with other embodiments of the invention, the primary seal element 44 may be located above the secondary seal element 45. As another example, in accordance with other embodiments of the invention, the additional loading force that is provided by the secondary seal element 45 may be used to assist another operation of the packer 40, such as an operation that involves the radial expansion of the slips 50. Furthermore, the secondary seal element 45 may be used for purposes of a contingency setting load or a redundant setting load, in accordance with other embodiments of the invention. Thus, many variations are contemplated and are within the scope of the appended claims.

Figure 6:
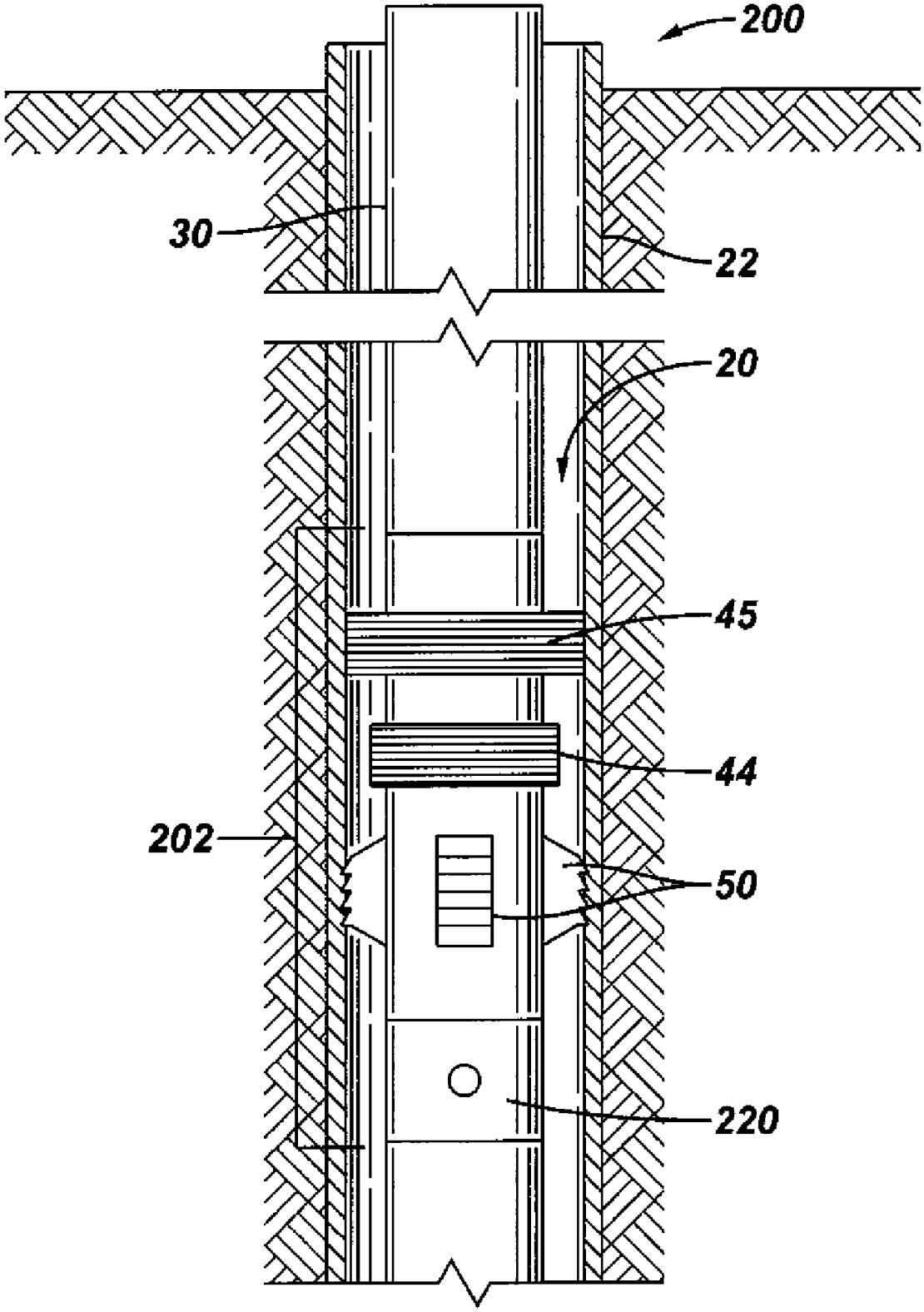

The operations of tools that are and are not part of the packer 40 may be assisted using the packer's secondary seal element 45 in accordance with the various embodiments of the invention. For example, FIG. 6 depicts an exemplary packer 202 (of a well 200) in accordance with other embodiments of the invention. The packer 202 shares common features with the packer 40 (see FIG. 1), with like reference numerals being used to denote similar components. The packer 202 is set and released in stages: the secondary seal element 45 is the first seal element to be set and/or the last seal element to be released when the packer 202 is unset.

The staged setting and/or release of the primary 44 and secondary 45 seal elements may be advantageous for certain applications. For example, the secondary seal element 45 may be set first to create the configuration that is set forth in FIG. 6. For this configuration, the differential pressure that is developed across the secondary seal element 45 may be used to drive the element 45 as a piston to operate a downhole tool, such as a flow control device 220 (a circulation valve, sleeve valve, ball valve, etc., depending on the particular embodiment of the invention) or other tool.

The configuration that is depicted in FIG. 6 may also occur after the first stage of a packer release occurs in which the primary seal element 44 has been retracted, or released, in a stage that precedes a stage in which the secondary seal element 45 is released. For this scenario, the configuration that is depicted in FIG. 6 is advantageous because the differential pressure across the secondary seal element 45 may be used to open the flow control device 220 to establish fluid communication between the central passageway of the string 30 and the well annulus. This permits fluid to flow out of the string 30 so that when the secondary seal element 45 is released, the packer 202 may be more easily run out of hole due to the removal of the column of fluid in the string 30. Conventionally, a flow control device in the string may be opened before packer retrieval to establish fluid communication between the central passageway of the string and the well annulus using an intervention operation. However, by using the secondary seal element 45 in the above-described manner, the time and cost associated with such an intervention is avoided.

Figure 7:
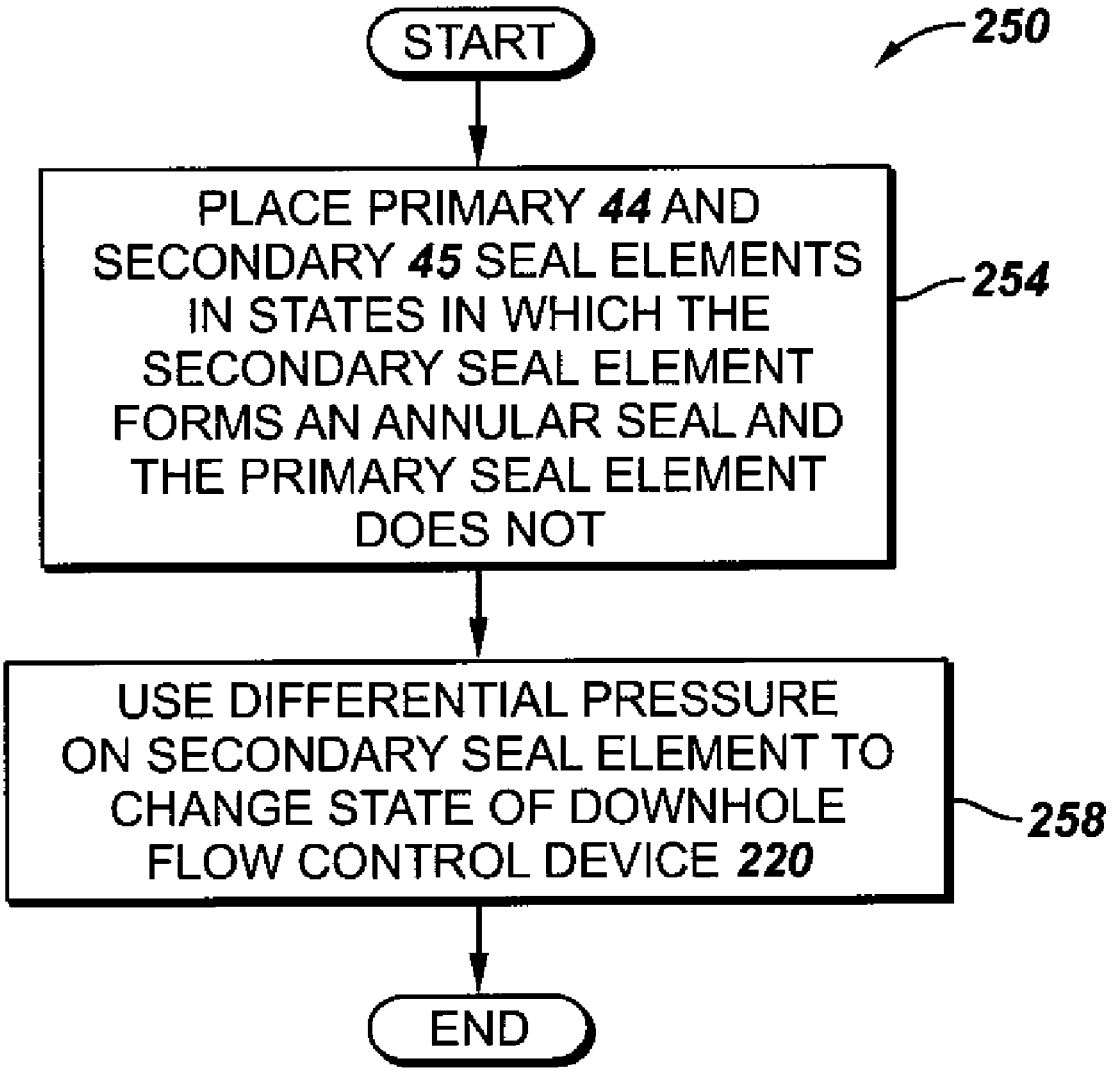

Thus, referring to FIG. 7, a technique 250 may be used in accordance with embodiments of the invention. Pursuant to block 254 of the technique 250, primary 44 and secondary 45 seal elements are placed in states in which the primary seal element 44 no longer forms an annular seal and the secondary seal element 45 forms an annular seal. The differential pressure across the secondary seal element 45 is used to change the state of a downhole flow control device 220, pursuant to block 258. Other variations are contemplated and are within the scope of the appended claims.

Other embodiments are within the scope of the appended claims. For example, in other embodiments of the invention, the primary seal element may be a seal element such as an inflatable bladder or swellable material, which forms an annular seal without being compressed. The flow control device may or may not be part of the packer. As another example, the operation that is assisted by the secondary seal element may be an operation of a tool that is not part of the packer.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A packer usable with a well, comprising:

a first external seal element adapted to form a first annular seal in the well; and a second external seal element adapted to form a second annular seal in the well and to move in response to a differential pressure across the second external seal element to produce a force to at least partially assist in radially expanding the first external seal element to form the first annular seal.

2. The packer of claim 1, further comprising:

a piston adapted to radially expand the first external seal element in response to the force.

3. The packer of claim 2, further comprising:

a ratchet to maintain a position of the piston produced by the force.

4. The packer of claim 1, further comprising:

an actuator to produce additional force to radially expand the first external seal element.

5. A method usable with a well, comprising:

providing a first external seal element of a packer to form a first annular seal in the well;

providing a second external seal element of the packer to form a second annular seal in the well; and moving the second external seal element in response to differential pressure across the second external seal element to produce a force to at least partially assist in radially expanding the first external seal element to form the first annular seal.

6. The method of claim 5, further comprising:

compressing the first external seal element in response to the force.

7. The method of claim 5, further comprising:

compressing the second external seal element to form the second annular seal in the well.

8. The method of claim 7, wherein the second annular seal is formed prior to the act of moving.

9. A system usable with a well, comprising:

a slip;

a piston;

a first external seal element adapted to be compressed by the piston to form an annular seal in the well; and a second external seal element adapted to be moved in response to fluid in the well to produce a force on the piston to at least partially assist the compression of the first external seal element by the piston.

10. The system of claim 9, further comprising:

an actuator to produce another force on the piston to compress the first external seal element; and a ratchet to maintain a position of the piston in response to movement of the piston due to said another force.

11. The system of claim 10, further comprising:

another ratchet to maintain a position of the piston in response to movement of the piston due to the force produce by movement of the second external seal element.

12. The system of claim 9, further comprising:

a ratchet to maintain a position of the piston in response to movement of the piston due to the force produce by movement of the second external seal element.

13. A packer usable with a well, comprising:

a first external seal element adapted to form an annular seal in the well; and a second external seal element adapted to be moved in response to fluid in the well to produce a force to at least partially assist an operation of a downhole tool other than the packer.

14. The packer of claim 13, wherein the second external seal element is adapted to move in response to well fluid pressure to at least partially assist in radially expanding the first external seal element to form the annular seal.

15. The packer of claim 13, further comprising:

a slip, wherein the second external seal element is adapted to move in response to well fluid pressure to at least partially assist in radially expanding the slip.

16. The packer of claim 13, wherein the downhole tool comprises a flow control device.

17. A packer usable with a well, comprising:

a first external seal element adapted to form an annular seal in the well;

a slip; and a second external seal element adapted to form another annular seal in the well, the second external seal element being adapted to move in response to well fluid pressure to at least partially assist in radially expanding the slip.

18. The packer of claim 17, further comprising:

a piston adapted to radially expand the slip in response to movement of the second external seal element.

19. The packer of claim 17, further comprising:

a ratchet to maintain a position of the piston.

20. A method usable with a well, comprising:

providing a first external seal element of a packer to form an annular seal in the well; and moving a second external seal element of the packer in response to differential pressure across the second external seal element to produce a force to at least partially assist in radially expanding a slip of the packer, the second external seal element being adapted to form another annular seal in the well.

21. The method of claim 20, further comprising:

moving a piston in response to the differential pressure to radially expand the slip.

22. The method of claim 20, further comprising:

using a ratchet to secure a radially expanded position of the slip.

23. An apparatus usable with a well, comprising:

a first external seal element adapted to form an annular seal in the well;

a flow control device; and a second external seal element adapted to form another annular seal in the well, the second external seal element being adapted to move in response to well fluid pressure to at least partially assist in operating the flow control device.

* * * * *